US008202140B2

(12) United States Patent
Hong et al.

(10) Patent No.: US 8,202,140 B2
(45) Date of Patent: Jun. 19, 2012

(54) WAFER POLISHING CARRIER APPARATUS AND CHEMICAL MECHANICAL POLISHING EQUIPMENT USING THE SAME

(75) Inventors: Yong-Sung Hong, Hwaseong-si (KR); Jong-Yoon Park, Seoul (KR); Hyun-Joon Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 959 days.

(21) Appl. No.: 12/231,529

(22) Filed: Sep. 3, 2008

(65) Prior Publication Data

US 2009/0068934 A1 Mar. 12, 2009

(30) Foreign Application Priority Data

Sep. 4, 2007 (KR) ..... 10-2007-0089262

(51) Int. Cl.
*B24B 29/00* (2006.01)
*B24B 47/00* (2006.01)

(52) U.S. Cl. ..... 451/67; 451/72; 451/288; 451/291; 451/400; 451/443

(58) Field of Classification Search ..... 451/65, 451/67, 72, 285, 286, 287, 288, 289, 290, 451/291, 333, 338, 339, 400, 402, 443, 444
See application file for complete search history.

(56) References Cited

U.S. PATENT DOCUMENTS

| | | | | |
|---|---|---|---|---|
| 5,738,574 | A * | 4/1998 | Tolles et al. | 451/288 |
| 6,402,598 | B1 | 6/2002 | Ahn et al. | |
| 7,537,512 | B2 * | 5/2009 | Seo | 451/41 |

FOREIGN PATENT DOCUMENTS

| | | |
|---|---|---|
| JP | 11-176775 | 7/1999 |
| JP | 2000-127026 | 5/2000 |
| KR | 10-0568031 | 3/2006 |

* cited by examiner

*Primary Examiner* — Timothy V Eley
(74) *Attorney, Agent, or Firm* — Onello & Mello, LLP

(57) ABSTRACT

A wafer polishing carrier apparatus and a chemical mechanical polishing equipment employing the same includes a drive rotary union rotating on an axis and receiving a flow of fluid through a first conduit in a sealed-up state; driven rotary unions revolving on their own axis at different sides of the drive rotary union, and receiving the flow of fluid from the drive rotary union through a second conduit in a sealed-up state; a carrier attached to an end part of the driven rotary union to adsorb/detach a wafer using a fluid pressure provided through a third conduit connected through the second conduit; and a filter filtering pollution material in the fluid flowing in and out of the third conduit on the periphery of the carrier to prevent the pollution material from escaping external to the carrier, the pollution material generated from rotation of the drive rotary union and driven rotary unions.

20 Claims, 4 Drawing Sheets

WAFER POLISHING CARRIER APPARATUS AND CHEMICAL MECHANICAL POLISHING EQUIPMENT USING THE SAME

CROSS REFERENCE TO RELATED APPLICATIONS

This application claims priority under 35 U.S.C. §119 from Korean Patent Application 10-2007-0089262, filed on Sep. 4, 2007, the contents of which are hereby incorporated by reference in their entirety for all purposes as if fully set forth herein.

BACKGROUND AND SUMMARY

1. Technical Field

The present invention relates to a wafer polishing carrier apparatus and to chemical mechanical polishing equipment employing the same, and more particularly, to a wafer polishing carrier apparatus for pressurizing a wafer on a platen with a given pressurized force and moving it, and chemical mechanical polishing equipment employing the same.

2. Description

Recent rapid developments in the field of information communication and a popularization of information on information media, such as computer etc., have brought about a remarkable growth in semiconductor devices. The semiconductor device simultaneously requires a high-speed operation and a large capacity of storage in view of increased demands in functionality. This causes increased burdens on and cost of manufacturing technology of the semiconductor device in an effort to improve integration, reliability and response speed etc. The manufacturing technology of semiconductor device includes a deposition process for forming a processing layer on a wafer, and a photolithography process and etching process for forming a processed-layer on the processing layer formed through the deposition and patterning it. Recently, a planarization process to uniformly planarize the surface of wafer with a step coverage is added.

The planarization process is generally performed by chemical mechanical polishing equipment useful for mechanically abrading a wafer and also chemically polishing the wafer by supplying slurry onto the surface of the wafer. The chemical mechanical polishing equipment is adapted to pressurize the wafer disposed on a platen to which a polishing pad having a given friction coefficient adheres, by a given pressurization force, and to polish the wafer. The wafer is adapted to horizontally move in a state of being pressurized onto the platen by a wafer polishing carrier apparatus, as a polishing head device. At this time, the wafer and the platen relatively rotate, abrading the surface of wafer and the polishing pad associated with the platen. Thus, in the current state of chemical mechanical polishing equipments according to conventional art, a relative movement direction of wafers or platens may be designed with a partial difference.

The chemical mechanical polishing equipment described below according to a conventional art is configured to revolve a wafer around the platen and simultaneously rotate it on its own axis by a given rotation speed. The revolution versus rotation rate of the wafer is determined as the same or similar rate. The wafer polishing carrier apparatus is configured to pressurize the wafer by a given pressurization force or adsorbing it by a given adsorption force so that the wafer is revolved around the platen or rotated on its own axis.

The wafer polishing carrier apparatus is configured to include a drive rotary union and a driven rotary union that are engaged with each other to rotate, so as to revolve, the wafer around the platen and rotate it on its own axis. The wafer polishing carrier apparatus may be configured to further include a carrier for holding the wafer at an end part of the driven rotary union by using a fluid, such as air flowing through plural rotary unions. Here the carrier is adapted to adsorb or detach the wafer by using a pressure of fluid provided through a conduit connected with plural rotary unions.

The drive rotary union and the driven rotary union each comprise a mechanical seal part configured in a direction vertical to each rotation axis to seal and flow the fluid supplied by a given pressure. The mechanical seal part is adapted to prevent the fluid from leaking from a portion of an axis or rotation body rotating by a given speed. Here the mechanical seal part has a structure for providing a complete adhesion of a metal part and a carbon or antimony portion through a sliding movement so as to maintain a liquid-tightened state.

However, in a wafer polishing carrier apparatus and chemical mechanical polishing equipment employing the same, pollution material such as a carbon or antimony component generated by an abrasion of each mechanical seal part of drive rotary union and driven rotary union leaks onto a platen, thus causing a process error of chemical mechanical polishing processor, such as scratch on wafer, resulting in a decrease of production yield.

Furthermore a partial pollution from the pollution material is easy to generate on a polishing pad and in a narrow inner diameter portion of conduit adapted in a lower part or end part of carrier coupled to the drive rotary union and driven rotary union, thus it is frequently required to perform cleaning work of the conduit and polishing pad, causing a decrease of productivity.

SUMMARY OF INVENTION

Accordingly, some aspects of the invention provided are a wafer polishing carrier apparatus and a chemical mechanical polishing equipment employing the same, which is capable of preventing a process error of chemical mechanical polishing process causable by pollution material generated by an abrasion of respective mechanical seal parts of a drive rotary union and a driven rotary union, the pollution material being effluent to a polishing pad, thereby increasing a production yield. Additionally, a partial pollution on a polishing pad and in a narrow inner diameter portion of conduit adapted in a lower part or end part of carrier can be prevented and a cleaning work can be simplified or substantially reduced, thus productivity can be increased.

According to an aspect of the invention, a wafer polishing carrier apparatus comprises a drive rotary union configured to rotate on a given axis and to receive a flow of fluid flowing through a first conduit in a sealed-up state thereof; driven rotary unions configured to revolve on their own axis at different sides of the drive rotary union and to receive the flow of the fluid flowing from the drive rotary union through a second conduit in a sealed-up state thereof; carriers, each carrier attached to an end part of a different one of the driven rotary unions to adsorb or detach a wafer by using a pressure from the flow the fluid provided through a third conduit connected to the second conduit of the corresponding driven rotary union; and a filter configured to filter pollution material contained in the flow of the fluid as it flows in and out of the third conduit on a periphery of the carrier so as to prevent the pollution material from escaping external to the carrier, the pollution material being generated from the rotation of the drive rotary union and the driven rotary union.

The carrier can comprise a carrier adapter that is combined with an end part of the driven rotary union and that is provided with the third conduit extended from the second conduit of the driven rotary union, and a carrier head configured to suck or separate the wafer by using the flow of the fluid through the third conduit of the carrier adapter, the carrier head being formed to surround a rear face and an outer circumference of the wafer.

The filter can be adapted in a plurality of tubes coupled with a plurality of connectors to which the third conduit of the carrier adapter is external to the carrier adapter.

The fluid can be air and the filter can comprise a dry filter configured to filter the pollution material contained in the air by using pressure of the air flowing through the third conduit.

The filter can be configured to filter pollution material having a size of 1 μm or larger contained in the air.

The filter can comprise a plurality of individual filters sequentially arrayed, each of the plurality of individual filters comprising a filtering material or filtering mesh with numerous holes, at least some holes having different sizes.

The drive rotary union can comprise a central fixation axis including a plurality of first conduits adapted in a lengthwise direction through which the flow of the fluid flows, a hollow rotary axis rotating along a girth of the central fixation axis to open end parts of the plurality of first conduits, a seal housing spaced by a given distance from the hollow rotary axis and formed to surround the hollow rotary axis, a fluid pipe branched from the seal housing for providing the flow of the fluid into the driven rotary union, and spins formed to surround a periphery of the fluid pipe and the driven rotary union.

The driven rotary union can comprise a second seal housing coupled to the fluid pipe of the drive rotary union, and a driven axis in which a second conduit is formed, the second conduit configured to rotate on a center of the second seal housing and to flow the fluid.

The carrier can comprise a carrier adapter that is combined with an end part of the driven axis of the driven rotary union and that is provided with the third conduit extended from the second conduit of the driven axis, and a carrier head for sucking or separating the wafer using the flow of the fluid through the third conduit of the carrier adapter, the carrier head being formed to surround a rear face and an outer circumference of the wafer.

The third conduit can be exposed to a plurality of connectors formed into a sidewall of the carrier adapter and is coupled to a tube adapted external to the carrier adapter.

The filter can be configured to filter the pollution material contained in the flow of the fluid as it flows through the tube.

According to another aspect of the invention, a polishing unit for use in a chemical mechanical polishing apparatus comprises a platen provided with a polishing pad having a given surface roughness; a slurry supply nozzle configured to supply a slurry onto the polishing pad of the platen; a pad conditioner configured to grind a surface of the polishing pad at an upper part of the platen adjacent to the slurry supply nozzle; and a wafer polishing carrier apparatus. The wafer polishing carrier apparatus includes a drive rotary union configured to rotate on a given axis and to receive a flow of fluid through a first conduit in a sealed-up state thereof, and to position the pad conditioner and the slurry supply nozzle above the platen; driven rotary unions configured to revolve on their axis at different sides of the drive rotary union and to receive the flow of the fluid from the drive rotary union through a second conduit in a sealed-up state thereof, carriers, each carrier attached to an end part of a different one of the driven rotary unions to adsorb or detach a wafer by using a pressure from the flow of the fluid provided through a third conduit connected to the second conduit of the corresponding driven rotary union, and a filter configured to filter pollution material contained in the flow of the fluid as it flows in and out of the third conduit on a periphery of the carrier so as to prevent the pollution material from escaping external to the carrier, the pollution material being generated from a rotation of the drive rotary union and the driven rotary union.

The carrier can comprise a carrier adapter that is combined with an end part of the driven rotary union and that is provided with the third conduit extended from the second conduit of the driven rotary union, and a carrier head configured to suck or separate the wafer by using the flow of the fluid through the third conduit of the carrier adapter, the carrier head being formed to surround a rear face and an outer circumference of the wafer.

The filter can be adapted in a plurality of tubes coupled with a plurality of connectors to which the third conduit of the carrier adapter is external to the carrier adapter.

The fluid can be air and the filter can comprise a dry filter configured to filter the pollution material contained in the air by using pressure of air flowing through the third conduit.

The filter can be configured to filter pollution material having a size of 1 μm or larger contained in the air.

The filter can comprise a plurality of individual filters sequentially arrayed, each of the plurality of individual filters comprising a filtering material or filtering mesh with numerous holes, at least some holes having different sizes.

According to another aspect of the invention, a chemical mechanical polishing apparatus comprises a wafer cassette load port configured to load a plurality of wafer cassettes thereon, the plurality of cassettes configured to hold a plurality of wafers; a factory interface configured to take out a wafer from one of the plurality of wafer cassettes loaded on the wafer cassette load port and to transfer the wafer to a polishing unit, then to a cleaning and drying device, and then to mount the wafer onto one of the plurality of wafer cassettes; and a wafer polishing carrier apparatus. The wafer polishing carrier apparatus includes a drive rotary union configured to rotate at a center upper part of a platen provided with a polishing pad having a given surface roughness, and to receive a flow of fluid through a first conduit in a sealed-up state thereof, driven rotary unions configured to revolve on their own axis at different sides of the drive rotary union and to receive the flow of the fluid from the drive rotary union through a second conduit in a sealed-up state thereof, carriers, each carrier attached to an end part of a different one of the driven rotary unions to adsorb or detach the wafer by using a pressure from the flow of the fluid provided through a third conduit connected to the second conduit of the corresponding driven rotary union, and a filter configured to filter pollution material contained in the flow of the fluid as it flows in and out of the third conduit on a periphery of the carrier so as to prevent the pollution material from escaping external to the carrier, the pollution material being generated from a rotation of the drive rotary union and the driven rotary union.

The carrier can comprise a carrier adapter that is combined with an end part of the driven rotary union and that is provided with the third conduit extended from the second conduit of the driven rotary union, and a carrier head configured to suck or separate the wafer by using the flow of the fluid through the third conduit of the carrier adapter, the carrier head being formed to surround a rear face and an outer circumference of the wafer.

The filter can be adapted in a plurality of tubes coupled with a plurality of connectors to which the third conduit of the carrier adapter is external to the carrier adapter.

As described above, according to some aspects of the invention, a filter for filtering pollution material contained in fluid flowing through a conduit of carrier for adsorbing and detaching a wafer is adapted in an end part of a driven rotary union, thereby removing pollution material having carbon components generated in each mechanical seal part of a drive rotary union and a driven rotary union. Thus production yield is increased.

Further, according to some aspects of the invention, a filter for filtering pollution material contained in fluid supplied to a carrier through a drive rotary union and a driven rotary union is provided, thereby preventing a polishing pad for polishing a wafer held by the carrier from being polluted by pollution material and simplifying or reducing the work of cleaning the conduit and the polishing pad and thus increasing productivity.

BRIEF DESCRIPTION OF THE DRAWINGS

The present invention will become more fully understood from the detailed description given hereinbelow and the accompanying drawings. The embodiments depicted therein are provided by way of example, not by way of limitation, wherein like reference numerals refer to the same or similar elements. The drawings are not necessarily to scale, emphasis instead being placed upon illustrating aspects of the invention. In the drawings.

DETAILED DESCRIPTION

Embodiments in accordance with the present invention now will be described hereinafter with reference to the accompanied drawings. This invention can, however, be embodied in many different forms and should not be construed as limited to the embodiments set forth herein. For purposes of clarity, a detailed description of known functions and systems has been omitted.

It will be understood that, although the terms first, second, etc. are be used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

It will be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Spatially relative terms, such as "beneath," "below," "lower," "above," "upper" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

Figure 1:
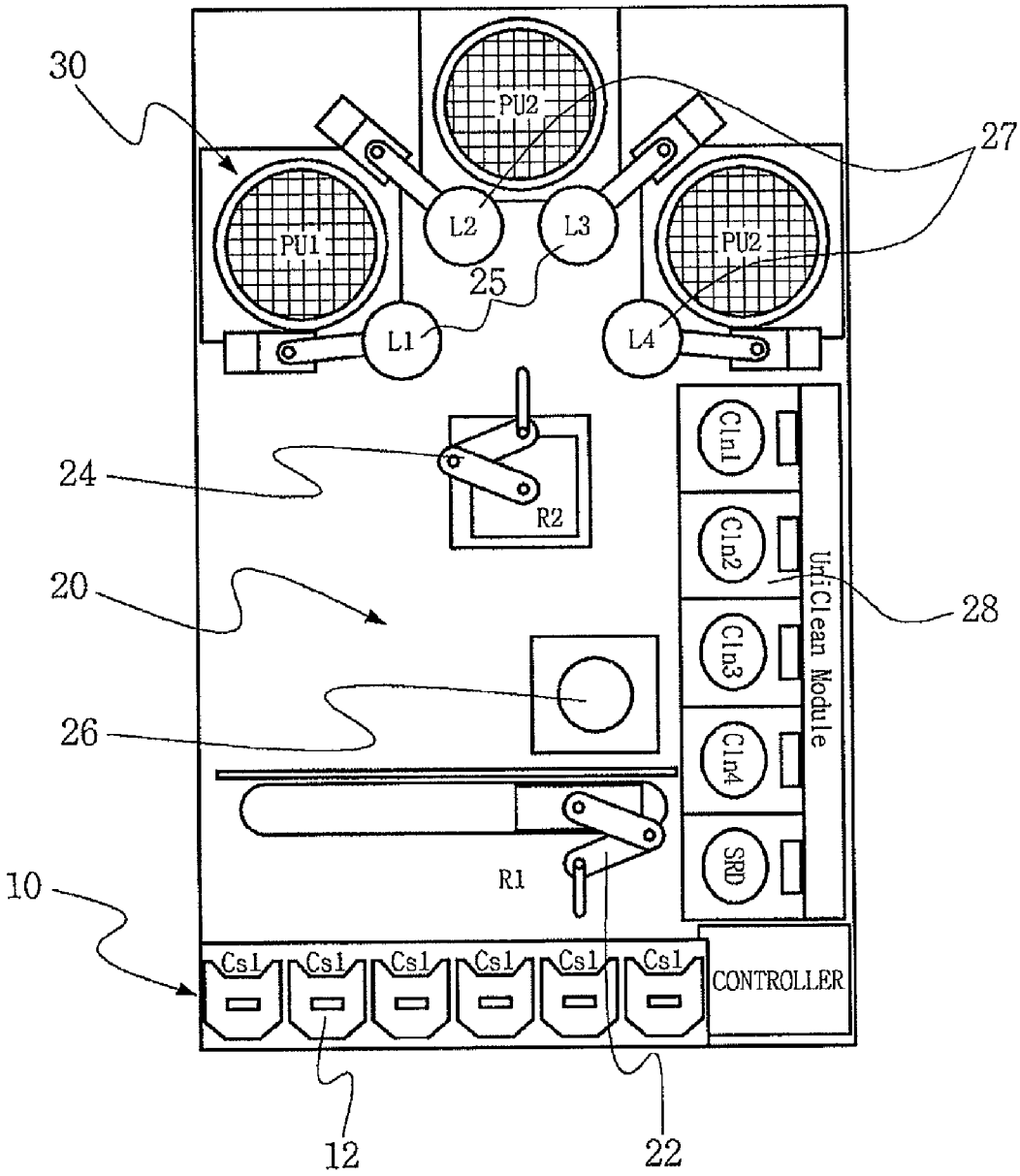
FIG. 1 is a plan view schematically illustrating an embodiment of a chemical mechanical polishing unit according to an aspect of the invention.

FIG. 1 is a plan view schematically illustrating an embodiment of a chemical mechanical polishing unit according to an aspect of the invention.

Referring to FIG. 1, a chemical mechanical polishing unit according to this embodiment comprises a load port 10 on which a plurality of wafer cassettes 12 are placed and a factory interface 20 for taking out and moving wafers (see wafer 100 of FIG. 3) piece-by-piece from the plurality of wafer cassettes 12, cleaning the wafer 100 after completion of a polishing process, and then mounting the wafer back onto the wafer cassette 12, and a polishing unit 30 for chemically and mechanically polishing the wafer 100 supplied through the factory interface 20. The chemical mechanical polishing unit 10 can further comprise a control unit (or controller) for outputting control signals to the factory interface 20 and the polishing unit 30 to sequentially supply the wafers 100 and to facilitate the chemical mechanical polishing of wafer 100.

The plurality of wafer cassettes 12 are safely mounted on the load port 10, and plural wafers 100 are horizontally mounted on the plurality of wafer cassettes 12. The factory interface 20 is configured to take out any one of the plural wafers 100 mounted within the plurality of wafer cassettes 12 by using a first robot 22, and to place the wafer on a wafer station 26, and to load the wafer onto a loading device 25 (e.g., L1 and L3) of the polishing unit 30 by using a second robot 24. Further, the factory interface 20 is configured to unload wafer 100, having undergone the CMP process by the polishing unit 30, from the unloading device 27 (e.g., L2 and L4) to a plurality of unit cleaning devices 28 (e.g., Cln1-Cln4) by using the second robot 24, and to mount the wafer 100 after completion of a cleaning and dry process onto the wafer cassette 12 from the plurality of unit cleaning devices 28 by using the first robot 22.

Figure 2:
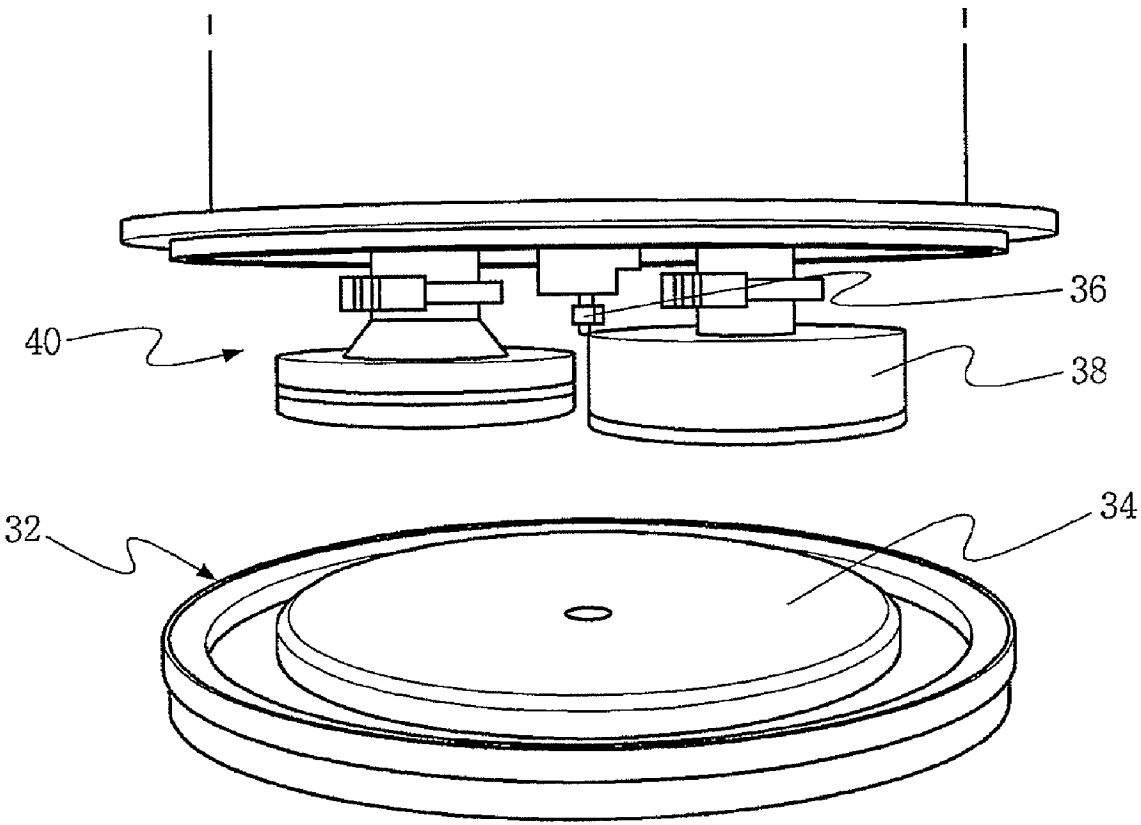
FIG. 2 is a perspective view of the polishing unit shown in FIG. 1.

FIG. 2 is a perspective view of an embodiment of polishing unit 30 shown in FIG. 1. The polishing unit 30 is configured to pressurize and planarize the wafer 100 loaded from the loading device 25 on the platen 32 through a given pressurization force by using a wafer polishing carrier apparatus 40. The platen 32 is covered with a polishing pad 34 that has a circular plate shape and that is formed of nonwoven fabric material having a given, known friction coefficient. The platen 32 vertically moves so that the polishing pad 34 is in contact with the surface of the wafer 100 or pressurizes the wafer 100 by a given pressure. Then the wafer 100 horizontally moves on the polishing pad 34 so that the surface of wafer 100 abrades by the polishing pad 34 as it is simultaneously planarized.

For example, there are together adapted a slurry supply nozzle 36 for supplying slurry between wafer 100 and the polishing pad 34, a pad conditioner 38 for grinding the surface of the polishing pad 34 and simultaneously reproducing a surface roughness of the polishing pad 34 of a given level, and the wafer polishing carrier apparatus 40. The wafer polishing carrier apparatus 40 is adapted to pressurize the wafer 100 by a predetermined pressurization force at an upper part of the platen 32 and to revolve the wafer 100 around the platen 32 and rotate it on its own axis.

Figure 3:
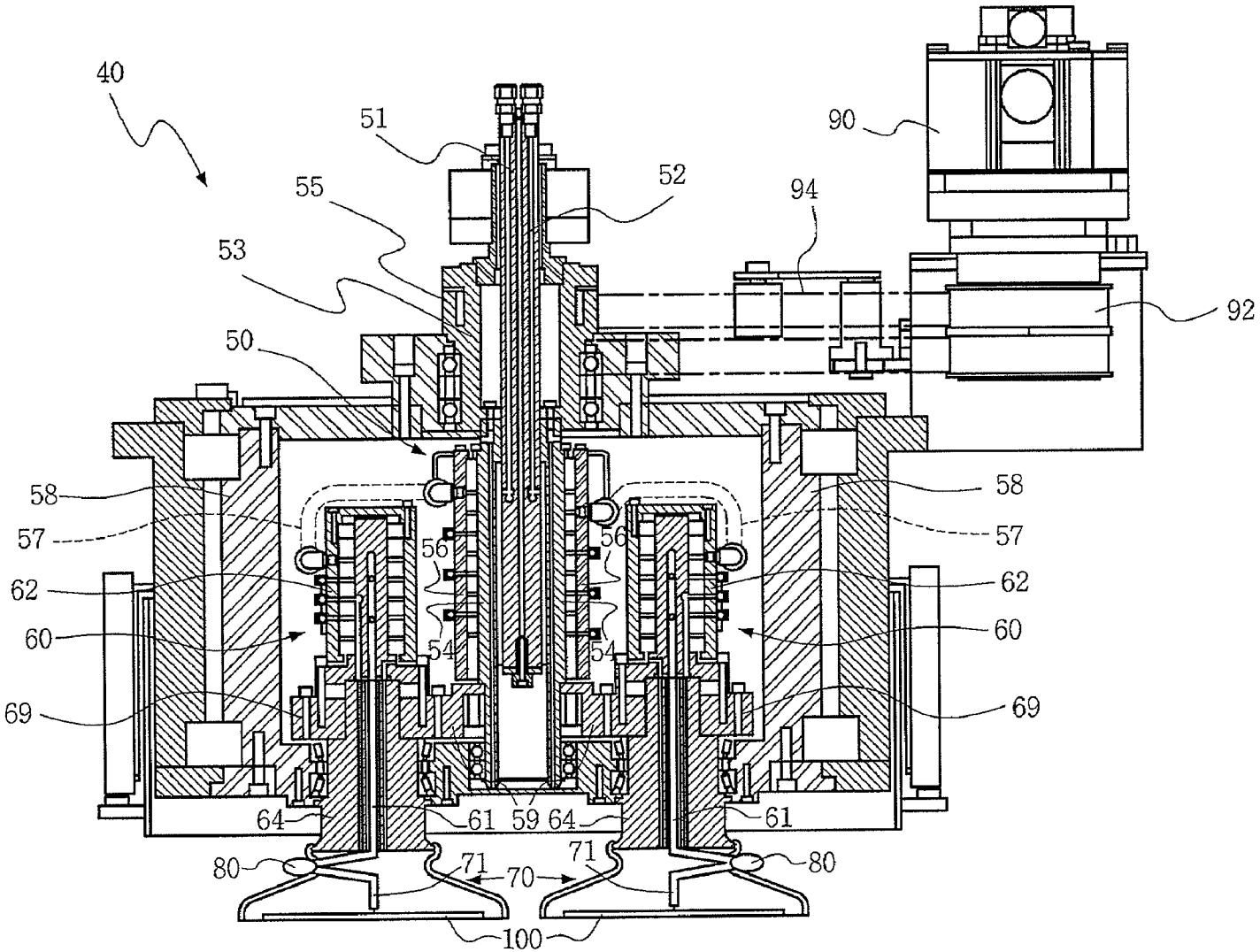
FIG. 3 is a sectional view of an embodiment of a wafer polishing carrier apparatus, according to aspects of the present invention.

FIG. 3 is a sectional view illustrating in detail an embodiment of the wafer polishing carrier apparatus 40.

As shown in FIG. 3, the wafer polishing carrier apparatus 40 comprises a drive rotary union 50 rotatable around a central fixation axis 52 adapted at a central upper part of the platen 32; driven rotary unions 60 configured to revolve on their own axis at both sides of the drive rotary union 50; a carrier 70 adapted in an end part of the driven rotary union 60 to hold a wafer; and a filter 80 for filtering pollution material contained in the fluid that flows through a plurality of first conduits 51 formed in the drive rotary unit 50 and then flows in and out through a plurality of third conduits 71 connected through a plurality of second conduits 61 adapted in the driven rotary union 60 to hold the wafer 100 by using a flow pressure.

The drive rotary union 50 revolves the wafer 100 held by the carrier 70 around the central fixation axis 52 by using a rotation power generated from an external rotation power generator. For example, the drive rotary union 50 is formed to receive rotation power from a belt 94 connected to a motor pulley 92 adapted in an end part of motor 90.

The drive rotary union 50 comprises central fixation axis 52 for which the plurality of first conduits 51 having a flow of fluid, such as air, are formed in a lengthwise direction, a hollow rotary axis 53, 54 rotating along the girth of the central fixation axis 52 to open end parts of the plurality of first conduits 51, a first seal housing 56 spaced by a given distance from the hollow rotary axis 53, 54 and formed to surround the hollow rotary axis 53, 54, a fluid pipe 57 branched from the first seal housing 56, for flowing the fluid into the driven rotary union 60, and spins 58 adapted surrounding the periphery of the fluid pipe 57 and the driven rotary union 60.

The central fixation axis 52 is fixed to a ceiling (not shown) of central upper part of the polishing pad 34 and is formed to flow in and out an air having a given pressure supplied through the first conduit 51 from a pressure controller (not shown).

The hollow rotary axis 53, 54 comprises an upper hollow rotary axis 53 provided with a drive pulley 55 that is connected to the motor pulley 92 through the belt 94 to receive rotation power, and a lower hollow rotary axis 54 provided with a drive gear 59 for rotating the driven rotary union 60. The lower hollow rotary axis 54 and the first seal housing 56 are a packing unit surrounding the central fixation axis 52, and form a first mechanical seal part for flowing the fluid having a given pressure in a sealed-up state into the lower hollow rotary axis 54 rotating along an outer circumference face of the central fixation axis 52.

Although not shown in the drawing, the first mechanical seal part comprises a fixation ring adapted to correspond to a metal portion of the central fixation axis 52, and a rotary ring adapted so that the lower hollow rotary axis 54 and the first seal housing 56 completely close and adhere onto the fixation ring to have a sliding movement along it. The sliding movement of the fixation ring and the rotary ring is generated through maintaining the adhesion force using a floating force of a spring from a lower part thereof. The fixation ring and rotary ring maintain the adhesion force with the lower hollow rotary axis 54 and the first seal housing 56 by a substantially uniform contact, a pressure of operating solution applied to the rotary ring, and a force of the spring etc., thereby preventing a leakage of fluid from a face having the sliding movement. Thus, there are advantages realized in that a power loss through collision is relatively small and a generation of heat is relatively small. But the abrasion through the sliding movement is unavoidable and there is a possibility of corrosion from the operating solution, thus matter used for the mechanical seal should be selected carefully. For example, the fixation ring can be formed of copper alloy or stainless steel, and the rotary ring can be formed of carbon material or antimony material having a prominent abrasion resistance. Here the pressure of fluid, such as air flowing through the first mechanical seal part, is predetermined to be about 10 $kg/cm^2$ or below.

On an edge portion of the drive rotary union 50, plural driven rotary unions 60 are installed. The end part of the plurality of driven rotary unions 60 is coupled to pad conditioner 38 for holding the wafer 100 or grinding the carrier 70 and the polishing pad 34. Here the driven rotary union 60 is adapted to receive a rotation power from a driven gear 69 engaged with a drive gear 59 adapted in an end part of the drive rotary union 50.

In the chemical mechanical polishing unit according to one embodiment of the invention, the carrier 70 and the driven rotary union 60 are described in detail as follows.

The driven rotary union 60 comprises a second seal housing 62 coupled to the fluid pipe 57 of the drive rotary union 50, and a driven axis 64 in which second conduit 61 is adapted, the second conduit 61 rotating on a center of the second seal housing 62 and for flowing fluid. One side of the second seal housing 62 is coupled to another side of the fluid pipe 57 connected to the first seal housing 56. The second seal housing 62 is fixed to both sides of the drive rotary union 50, surrounding the driven axis 64, and is a second mechanical seal part that is adapted to flow the fluid into the driven axis 64, rotating at a given speed, in a sealed-up state. Thus, the second mechanical seal part does not rotate, unlike the first mechanical seal part, but is fixed thereto. For example, the second mechanical seal part is provided to prevent a leakage of fluid from the driven axis 64 rotating in a given speed. The second mechanical seal part comprises a rotary ring adapted corresponding to a metal portion rotating together with the driven axis 64, and a fixation ring formed so that the second seal housing 62 closely adheres to the rotary ring and thus performs a sliding movement. The rotary ring can be formed of copper alloy or stainless steel, and the fixation ring can be formed of carbon material or antimony material. Thus, in the second mechanical part there are advantages in that a power loss through collision is small as with the first mechanical seal part and a generation of heat is small, but an abrasion of the rotary ring and the fixation ring is unavoidable through the sliding movement, thus it can become a source of pollution generation.

Figure 4:
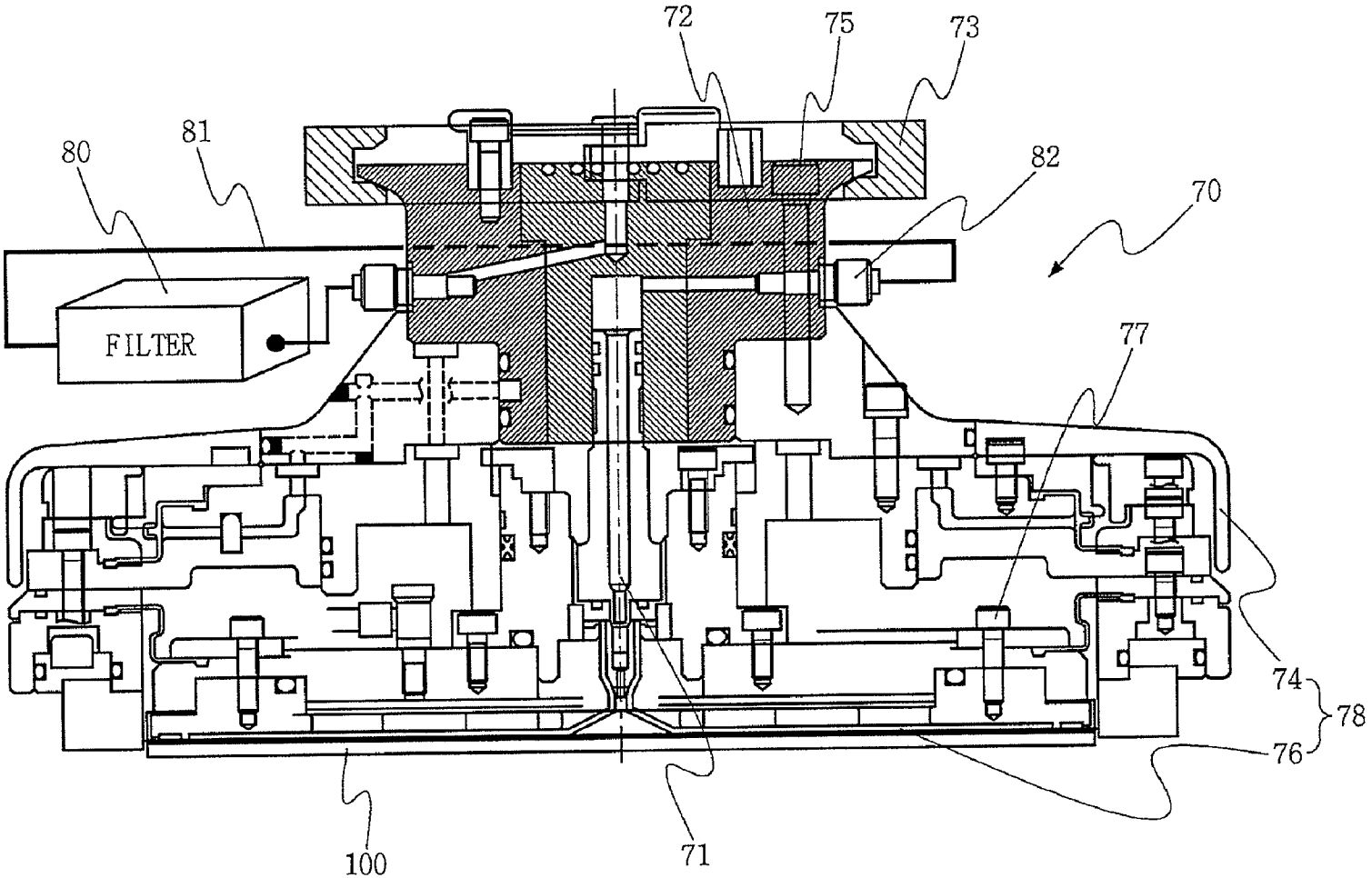
FIG. 4 is a sectional view of embodiments of a carrier and a filter of FIG. 3, according to aspects of the present invention.

FIG. 4 is a sectional view illustrating an embodiment of carrier 70 and filter 80 referred to in FIG. 3.

Referring to FIG. 4, the carrier 70 is adapted to hold and detach the wafer 100 by using a pressure of fluid flowing through the third conduit 71 extended from the second conduit 61 adapted in an end part of the driven axis 64 of the driven rotary union 60, and to pressurize above the platen 32—which are not shown in FIG. 4. For example, the carrier 70 comprises a carrier adapter 72 that is combined with an end part of the driven axis 64 of the driven rotary union 60 when attached thereto, and a carrier head 78. The carrier adapter 72 is provided with the third conduit 71, extended from the second conduit 61 of the driven axis 64. The carrier head 78 is configured for sucking or separating the wafer 100 by using the fluid flowing through the third conduit 71 of the carrier adapter 72. The carrier head 78 is formed surrounding a rear face and an outer circumference face of the wafer 100.

The carrier adapter 72 is adapted to connect the carrier head 78 to an end part of the driven axis 64 of the driven rotary union 60. The carrier adapter 72 and the carrier head 78 are configured in an assembly type to be easy to connect or release between the driven axis 64 of the driven rotary union 60 and the carrier 70. The carrier adapter 72 is adapted to be attached to or detached from a protrusion and an end part of the driven axis 64 by using a clamp 73, and is combined with the carrier head 78 through plural screws 75.

The carrier head 78 comprises a carrier housing 74 surrounding a rear face of the wafer 100, and a membrane sucking part 76 configured to suck the wafer 100 by a suction pressure of fluid flowing through third conduit 71 that passes through a center part of the carrier housing 74. The membrane sucking part 76 is in contact with a rear face of the wafer 100 located in a lower part of the carrier housing 74. The carrier head 78 can further comprise a wafer close-adhesion part 77 for closely adhering a rear-face edge part of the wafer 100 to the polishing pad 34 on the periphery of the membrane sucking part 76. The carrier housing 74 is adapted to surround a rear face and a side face of the wafer 100 and expose a fore face of the wafer 100 to the polishing pad 34. The membrane sucking part 76 is in direct contact with the rear face of the wafer, thus sucking or releasing the wafer 100 by using pressure of the fluid flowing through the third conduit 71.

Meanwhile, pollution material, such as carbon components and antimony Sb, generated in a large amount in the first and second mechanical seal parts can be contained in the fluid supplied through the third conduit 71 of the carrier head 78 and may flow to the wafer. Furthermore, pollution material may be dropped onto the polishing pad 34 provided in a lower part thereof when the membrane sucking part 76 detaches the wafer 100, thus causing an error in the chemical mechanical polishing process.

Therefore, the wafer polishing carrier apparatus 40, in accordance with the present embodiment and the invention, can employ a filter 80 for filtering pollution material of a given size or larger, thereby filtering the pollution material contained in the fluid flowing into the membrane sucking part 76 of the carrier head 78 from the third conduit 71.

For example, the filter 80 can be configured to filter pollution material contained in the fluid passing through the third conduit 71 adapted in the carrier adapter 72. Further, the filter 80 should drop a flow speed of fluid in the step of filtering the pollution material contained in the fluid, and thus is provided in a given volume and so is adapted to being exposed to the outside of the carrier adapter 72. Here, in the third conduit 71 adapted in the carrier adapter 72, a portion adjacent to the driven axis 64 and a portion adjacent to the carrier head 78 are each exposed to the outside of sidewall of the carrier adapter 72. In plural end parts of third conduit 71 exposed to the outside of carrier adapter 72, a plurality of connectors is connected to a tube 82 that is formed passing through the filter 80. Thus the filter 80 can filter pollution material contained in the fluid flowing through the tube 82.

Though not shown in FIG. 4, the filter 80 can be formed of one or more of various types filtering material or filtering mesh, such as a mesh or nonwoven fabric made of glass fiber, synthetic resin fiber, or multi-hole tube etc. Fluid passing through the third conduit 71 can be air. Thus, the filter 80 can be formed of a dry filter through which pollution material contained in the air is filtered through the filtering material or mesh by an air pressure. For example, the filter 80 may filter pollution material having a size of 1 μm or more contained in air, and can have a life of about 100 or 200 hours.

Also, the filter 80 can be formed of a plurality of individual filters sequentially arrayed, each of the individual filters can comprise filtering materials or meshes, such as a mesh or non-woven fabric made of glass fiber, synthetic resin fiber, or multi-hole tube, etc. Each filter can have numerous holes, and the holes in at least one individual filter can be of a different size than holes in at least one other individual filter. Though not shown in FIG. 4, the filter 80 can be formed of a plurality of individual filters sequentially arrayed, one or more of the plurality of individual filters having a filtering material or filtering mesh with numerous holes of different sizes. Here the filter 80 can filter pollution material generated in first and second seal parts of the drive rotary union 50 and the driven rotary union 60, and can filter pollution material such as particles sucked through a rear face of the wafer 100.

Accordingly, in wafer polishing carrier apparatus 40 and chemical mechanical polishing unit employing the same, according to some embodiments of the invention, filter 80 is adapted in carrier 70 for holding wafer 100, the filter 80 being for filtering pollution material contained in fluid, the pollution material being generated in first and second seal parts of drive rotary union 50 and driven rotary union 60 for rotating the wafer 100 around the platen or on its own axis, thereby preventing an error such as scratches caused by the pollution material in the chemical mechanical polishing process and thereby increasing a production yield.

The third conduit 71 adapted in a lower part or end part of the carrier head 78 has an inner diameter smaller than that in the carrier adapter 72, which is to increase a flow speed of fluid in the lower part or end part of the carrier head 78, the fluid having been flowed in an upper part of the carrier adapter 72 and the carrier head 78, thereby increasing a suction efficiency at a short distance from a rear face of the wafer 100. For example, when fluid containing a large amount of pollution material flows through the third conduit 71, it can be easy to generate pollution material in a lower part or end part of the carrier head 78 having a relatively narrower inner diameter. Further, in separating the wafer 100 from the carrier head 78, pollution material may be dropped to the outside of rear face of the wafer 100 together with fluid discharged through the third conduit 71, thus causing a partial pollution on the polishing pad 34.

Therefore, the wafer polishing carrier apparatus 40 and the chemical mechanical polishing unit employing the same, according to some embodiments of the invention, employ the filter 80 for filtering pollution material contained in fluid supplied to the carrier 70 through the drive rotary union 50 and the driven rotary union 60, thereby preventing third conduit 71 through which the fluid flows in the carrier 70 and the polishing pad 34 for polishing the wafer 100 held by the carrier 70, from being polluted by pollution material, and additionally simplifying or reducing a cleaning work of the third conduit 71 and the polishing pad 34, thereby increasing a productivity.

It will be apparent to those skilled in the art that modifications and variations can be made in the present invention without deviating from the spirit or scope of the invention. Thus, it is intended that the present invention cover any such modifications and variations within the scope of the appended claims and their equivalents. For example, it is not essential that a plurality of filters 80 are adapted in a plurality of third conduits connected through a plurality of first and second conduits coupled with first and second mechanical seal parts of a drive rotary union and a driven rotary union. Accordingly, these and other changes and modifications are seen to be within the true spirit and scope of the invention as defined by the appended claims.

In the drawings and specification, there have been disclosed typical embodiments of the invention and, although specific terms are employed, they are used in a generic and descriptive sense only and not for purposes of limitation, the scope of the invention being set forth in the following claims.

What is claimed is:

1. A wafer polishing carrier apparatus, comprising:

a drive rotary union configured to rotate on a given axis and to receive a flow of fluid through a first conduit in a sealed-up state thereof;

driven rotary unions configured to revolve on their own axis at different sides of the drive rotary union, and to receive the flow of the fluid from the drive rotary union through a second conduit in a sealed-up state thereof;

carriers, each carrier attached to an end part of a different one of the driven rotary unions to adsorb or detach a wafer by using a pressure from the flow of the fluid provided through a third conduit connected to the second conduit of the corresponding driven rotary union; and a filter configured to filter pollution material contained in the flow of the fluid as it flows in and out of the third conduit on a periphery of each carrier to prevent the pollution material from escaping external to each carrier, the pollution material being generated from a rotation of the drive rotary union and the driven rotary union.

2. The apparatus of claim 1, wherein each carrier comprises a carrier adapter that is combined with an end part of the driven rotary union and that is provided with the third conduit extended from the second conduit of the driven rotary union, and a carrier head configured to suck or separate the wafer by using the flow of the fluid through the third conduit of the carrier adapter, the carrier head being formed to surround a rear face and an outer circumference of the wafer.

3. The apparatus of claim 2, wherein the filter is adapted in a plurality of tubes coupled with a plurality of connectors to which the third conduit of the carrier adapter is external to the carrier adapter.

4. The apparatus of claim 1, wherein the fluid is air and the filter comprises a dry filter configured to filter the pollution material contained in the air by using pressure of the air flowing through the third conduit.

5. The apparatus of claim 4, wherein the filter is configured to filter pollution material having a size of 1 μm or larger contained in the air.

6. The apparatus of claim 1, wherein the filter comprises a plurality of individual filters sequentially arrayed, each of the plurality of individual filters comprising a filtering material or filtering mesh with numerous holes, at least some holes having different sizes.

7. The apparatus of claim 1, wherein the drive rotary union comprises a central fixation axis including a plurality of first conduits adapted in a lengthwise direction through which the flow of the fluid flows, a hollow rotary axis rotating along a girth of the central fixation axis to open end parts of the plurality of first conduits, a seal housing spaced by a given distance from the hollow rotary axis and formed to surround the hollow rotary axis, a fluid pipe branched from the seal housing for providing the flow of the fluid into the driven rotary union, and spins formed to surround a periphery of the fluid pipe and the driven rotary union.

8. The apparatus of claim 7, wherein the driven rotary union comprises a second seal housing coupled to the fluid pipe of the drive rotary union, and a driven axis in which a second conduit is formed, the second conduit configured to rotate on a center of the second seal housing and to flow the fluid.

9. The apparatus of claim 8, wherein each carrier comprises a carrier adapter that is combined with an end part of the driven axis of the driven rotary union and that is provided with the third conduit extended from the second conduit of the driven axis, and a carrier head for sucking or separating the wafer using the flow of the fluid through the third conduit of the carrier adapter, the carrier head being formed to surround a rear face and an outer circumference of the wafer.

10. The apparatus of claim 9, wherein the third conduit is exposed to a plurality of connectors formed into a sidewall of the carrier adapter and is coupled to a tube adapted external to the carrier adapter.

11. The apparatus of claim 1, wherein the filter is configured to filter the pollution material contained in the flow of the fluid as it flows through the tube.

12. A polishing unit for use in a chemical mechanical polishing apparatus, comprising:

a platen provided with a polishing pad having a given surface roughness;

a slurry supply nozzle configured to supply a slurry onto the polishing pad of the platen;

a pad conditioner configured to grind a surface of the polishing pad at an upper part of the platen adjacent to the slurry supply nozzle; and a wafer polishing carrier apparatus including:

a drive rotary union configured to rotate on a given axis and to receive a flow of fluid through a first conduit in a sealed-up state thereof and to position the pad conditioner and the slurry supply nozzle above the platen;

driven rotary unions configured to revolve on their own axis at different sides of the drive rotary union and to receive the flow of the fluid from the drive rotary union through a second conduit in a sealed-up state thereof;

carriers, each carrier attached to an end part of a different one of the driven rotary unions to adsorb or detach a wafer by using a pressure from the flow of the fluid provided through a third conduit connected to the second conduit of the corresponding driven rotary union; and a filter configured to filter pollution material contained in the flow of the fluid as it flows in and out of the third conduit on a periphery of each carrier so as to prevent the pollution material from escaping external to each carrier, the pollution material being generated from a rotation of the drive rotary union and the driven rotary union.

13. The unit of claim 12, wherein each carrier comprises a carrier adapter that is combined with an end part of the driven rotary union and that is provided with the third conduit extended from the second conduit of the driven rotary union, and a carrier head configured to suck or separate the wafer by using the flow of the fluid through the third conduit of the carrier adapter, the carrier head being formed to surround a rear face and an outer circumference of the wafer.

14. The unit of claim 13, wherein the filter is adapted in a plurality of tubes coupled with a plurality of connectors to which the third conduit of the carrier adapter is external to the carrier adapter.

15. The unit of claim 12, wherein the fluid is air and the filter comprises a dry filter configured to filter the pollution material contained in the air by using pressure of air flowing through the third conduit.

16. The unit of claim 15, wherein the filter is configured to filter pollution material having a size of 1 μm or larger contained in the air.

17. The unit of claim 12, wherein the filter comprises a plurality of individual filters sequentially arrayed, each of the plurality of individual filters comprising a filtering material or filtering mesh with numerous holes, at least some holes having different sizes.

18. A chemical mechanical polishing apparatus, comprising:

a wafer cassette load port configured to load a plurality of wafer cassettes thereon, the plurality of wafer cassettes configured to hold a plurality of wafers;

a factory interface configured to take out a wafer from one of the plurality of wafer cassettes loaded on the wafer cassette load port and to transfer the wafer to a polishing unit, then to a cleaning and drying device, and then to mount the wafer onto one of the plurality of wafer cassettes; and a wafer polishing carrier apparatus including:

a drive rotary union configured to rotate at a center upper part of a platen provided with a polishing pad having a given surface roughness, and to receive a flow of fluid through a first conduit in a sealed-up state thereof;

driven rotary unions configured to revolve on their own axis at different sides of the drive rotary union and to receive the flow of the fluid from the drive rotary union through a second conduit in a sealed-up state thereof;

carriers, each carrier attached to an end part of a different one of the driven rotary unions to adsorb or detach the wafer by using a pressure from the flow of the fluid provided through a third conduit connected to the second conduit of the corresponding driven rotary union, and a filter configured to filter pollution material contained in the flow of fluid as it flows in and out of the third conduit on a periphery of each carrier so as to prevent the pollution material from escaping external to each carrier, the pollution material being generated from a rotation of the drive rotary union and the driven rotary union.

19. The apparatus of claim 18, wherein each carrier comprises a carrier adapter that is combined with an end part of the driven rotary union and that is provided with the third conduit extended from the second conduit of the driven rotary union, and a carrier head configured to suck or separate the wafer by using the flow of the fluid through the third conduit of the carrier adapter, the carrier head being formed to surround a rear face and an outer circumference of the wafer.

20. The apparatus of claim 19, wherein the filter is adapted in a plurality of tubes coupled with a plurality of connectors to which the third conduit of the carrier adapter is external to the carrier adapter.

* * * * *